US009396887B2

(12) United States Patent
Rapisarda

(10) Patent No.: US 9,396,887 B2
(45) Date of Patent: Jul. 19, 2016

(54) SOLDERELESS MOTION SENSED SWITCH

(71) Applicant: Carmen Rapisarda, Apple Valley, CA (US)

(72) Inventor: Carmen Rapisarda, Apple Valley, CA (US)

( * ) Notice: Subject to any disclaimer, the term of this patent is extended or adjusted under 35 U.S.C. 154(b) by 191 days.

(21) Appl. No.: 14/275,657

(22) Filed: May 12, 2014

(65) Prior Publication Data

US 2014/0339058 A1 Nov. 20, 2014

Related U.S. Application Data

(60) Provisional application No. 61/823,854, filed on May 15, 2013, provisional application No. 61/858,877, filed on Jul. 26, 2013.

(51) Int. Cl.

| | |
|---|---|
| ***H01H 35/02*** | (2006.01) |
| ***H01H 35/14*** | (2006.01) |
| ***H01H 3/38*** | (2006.01) |

(52) U.S. Cl.

CPC ..... *H01H 3/38* (2013.01); *H01H 35/02* (2013.01); *H01H 35/14* (2013.01); *Y10T 29/49105* (2015.01)

(58) Field of Classification Search

CPC ..... H01H 3/38; H01H 35/02; H01H 35/14; H01H 35/144

USPC ..... 200/61.52, 61.51, 61.54 R, 61.45 R

See application file for complete search history.

(56) References Cited

U.S. PATENT DOCUMENTS

| | | | | |
|---|---|---|---|---|
| 6,784,386 | B2 * | 8/2004 | Chou | H01H 35/144 200/61.48 |
| 2005/0161309 | A1 * | 7/2005 | Weng | A43B 3/0005 200/61.45 R |
| 2009/0057110 | A1 * | 3/2009 | Chou | H01H 35/144 200/61.51 |

* cited by examiner

*Primary Examiner* — Renee Luebke
*Assistant Examiner* — Lheiren Mae E Caroc
(74) *Attorney, Agent, or Firm* — Roy L. Anderson

(57) ABSTRACT

A solderless motion switch uses an electrically conductive spring having two outer sections (with a greater diameter than an intermediate section) which rest on a surface having electrical connectors (such as a circuit board) in a rest mode. In the rest mode the intermediate section is suspended over an electrical connector in a motion mode, the intermediate section moves into contact with the electrical connector to close an electric circuit with an electrical connection between one of the outer sections and another electrical connecter. The spring is placed into contact with the surface without use of solder or mounting and is held positioned in place, during both the rest and motion modes, by a barrier, the assembly of which can be completed after the spring is positioned on the surface.

20 Claims, 3 Drawing Sheets

SOLDERELESS MOTION SENSED SWITCH

CROSS-REFERENCE TO RELATED APPLICATIONS

This application is a non-provisional application that claims priority from U.S. Ser. No. 61/823,854, filed May 15, 2013 and U.S. Ser. No. 61/858,877, filed Jul. 26, 2013, the disclosures of both of which are specifically incorporated herein by reference in their entireties.

FIELD OF THE INVENTION

The present invention is generally in the field of a new motion switch.

BACKGROUND OF THE INVENTION

Motion switches are used in various articles of manufacture, such as footwear and garments, for example, to actuate light modules or other modules based upon movement. Examples of prior motion switches include U.S. Pat. No. 6,238,058, RE37,220 and U.S. Pat. No. 7,766,501.

The switch disclosed in U.S. Pat. No. 6,238,058 has been used in millions of pieces of footwear. This switch relies upon a cantilevered spring that requires a spring mount to one end of the spring. The present invention seeks to improve upon prior motion switches by reducing their cast and making it easier to control the sensitivity of such switches.

SUMMARY OF THE INVENTION

The present invention is generally directed to a solderless motion switch in which two outer sections of a spring that is electrically conductive rest on a surface and a barrier positions the spring in both a rest mode and a motion mode. In the rest mode, one of the outer sections contacts a first electrical connector and an intermediate section of the spring, with a diameter less than that of the outer sections, is suspended over a second electrical connector. In the motion mode, an electrical circuit is completed when the first electrical connector is electrically connected with one of the outer sections and the second electrical connector is electrically connected with the intermediate section due to movement of the intermediate section.

Neither of the outer sections of the spring (which can be a coiled spring) are mounted to the surface (e.g., a circuit board) and the outer sections are preferably located at two ends of the spring while the intermediate section is located substantially in the middle of the spring. The spring can also be constructed so that the intermediate section has a diameter greater than sections located between it and the outer sections (with each of the like sections having identical length and diameters). A third electrical connector can be located underneath the second outer section, and one or all of the electrical connectors can be a conductive pad or an electrical trace.

Accordingly, it is a primary object of the present invention to provide an improved motion switch.

This and further objects and advantages will be apparent to those skilled in the art in connection with the drawings and the detailed description of the preferred embodiment set forth below.

BRIEF DESCRIPTION OF THE DRAWINGS

FIG. 2 illustrates a top view of a circuit board to which the motion switch of FIG. 1 has been assembled without a top barrier for the spring while

DETAILED DESCRIPTION OF THE INVENTION

Figure 1:
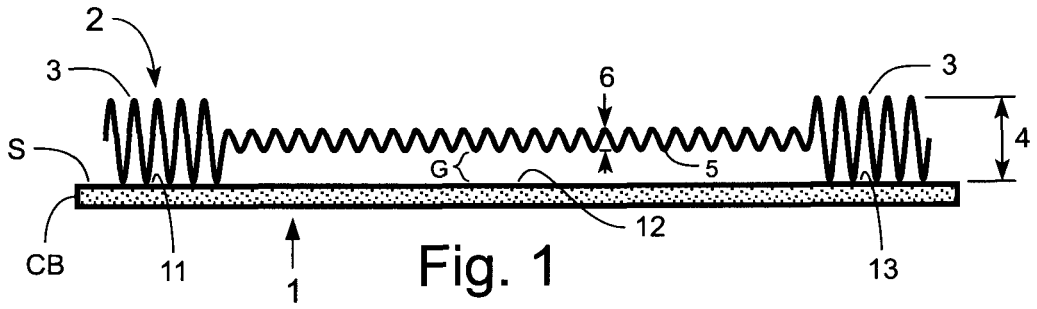
FIG. 1 is a schematic illustration of a novel motion switch in accordance with the present invention.

The present invention is generally directed to a novel motion switch useful in various articles of manufacture, such as toys, luggage, footwear or clothing, that has less parts and is easier to manufacture and assemble than prior art motion switches.

In the Figures and the following move detailed description, numerals indicate various features of the invention, with like numerals referring to like features throughout both the drawings and the description.

Although the Figures are described in greater detail below, the following is a glossary of the elements identified in the Figures:

1 motion control switch
2 spring
3 outer section of spring 2
4 outer diameter of outer section 3
5 intermediate section of spring 2
6 intermediate diameter of intermediate section 5
7 minimum section
8 minimum diameter of minimum section 7
11 first electrical connector
12 second electrical connector
13 third electrical connector
20 barrier
21 coffin box
22 coffin box lid
23 peg on coffin box 21
24 hole in PCB 25
25 printed circuit board
26 flex circuit
CB circuit board
CP conductive pad
E electronics
F flex circuit
G gap
S surface A motion control switch according to the present invention uses a spring that is electrically conductive and is not mounted to a surface S. The spring has an intermediate section that is suspended between two outer sections when the spring is at rest, meaning that when the two outer sections of the spring rest on surface S (which does necessarily need to be planar), the intermediate section is not resting on surface S and, hence, it is suspended above surface S, there being a gap between the intermediate section of the spring and surface S. Because the spring is not mounted to surface S, it requires no surface mount or solder, and therefore a motion control switch according to the present invention can be made solder-free with fewer components, and a lower cost, than prior art switches, while still presenting environmental benefits. It is preferred that the spring used in the present invention be a coiled spring, and it is especially preferred that the coils have a generally circular shape, as illustrated in the figures, but the invention is not meant to be limited to such a design. Accordingly, in the following description, when reference is made to a "diameter," the term is not meant to be limited to a circular diameter (e.g., if a non-circular coiled spring is used).

FIG. 1 illustrates a motion control switch, generally designated as 1, that utilizes a spring 2 which has two outer sections 3 with a greater outer diameter 4 than an intermediate section 5 with a lesser outer diameter 6. It is especially preferred that outer sections 3 be at terminating ends of spring 2, as illustrated in FIG. 1, but it is possible that additional portions of spring 2 can extend beyond outer sections 3, as is illustrated in FIG. 1B. It is also especially preferred that intermediate section 5 be located in the center of spring 2, as shown in FIG. 1, or at least be centered between outer sections 3, as illustrated in FIG. 1B, for greatest sensitivity of motion control switch 1.

In one embodiment shown in FIG. 1, spring 2 has a relatively uniform diameter in its middle section which creates a non-conductive gap G between intermediate diameter 6 of intermediate section 5 and surface S when motion control switch 1 is a rest mode.

Figure 1A:
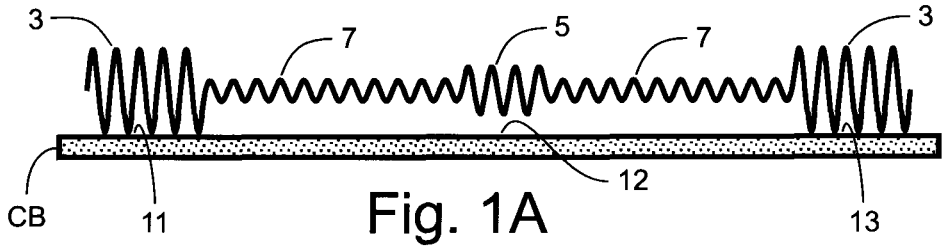
FIGS. 1A and 1B illustrate alternative springs for use in a novel motion switch in accordance with the present invention while FIG. 1B also illustrates use of conductive pads.
Figure 1B:
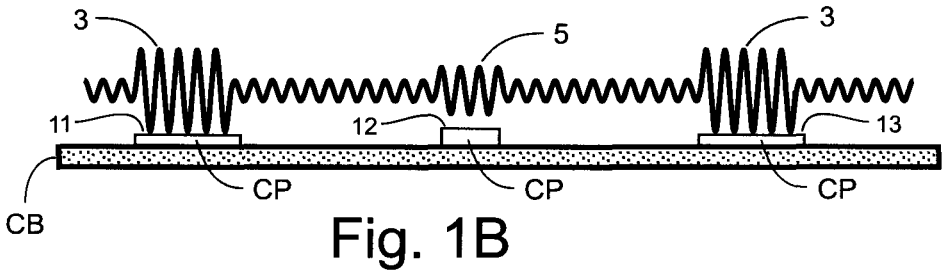

In another embodiment shown in FIG. 1A, intermediate diameter 6 is still less than outer diameter 4, but it is greater than minimum diameter 8 of minimum sections 7 located between outer sections 3 and intermediate section 5. In this particular embodiment the increased diameter of intermediate diameter 6 (as compared to that of FIG. 1) leads to increased sensitivity of motion control switch 1. Another way to increase such sensitivity is to ensure that intermediate section 5 has a greater mass than minimum sections 7 over an identical length (which can be done, for example, by having more coils in the identical length or increasing the mass of the coils in the intermediate section).

An advantage of using a coiled spring in accordance with the present invention is that a wire can be wrapped precisely around a mandrel to very precisely control the amount of the non-conductive gap G that exists between intermediate diameter 6 of intermediate section 5 and surface S when motion control switch 1 is a rest mode. Such precise control of gap G allows for greater sensitivity than can be achieved with a cantilevered spring. In addition, if the coiled spring has a circular cross section, it allows for increased sensitivity in and direction of the coiled spring.

Outer sections 3 each rest on a surface S to support spring 2. Surface S can be part of a circuit board CB which can be a printed circuit board ("PCB") or a flex circuit, and surface S has a first electrical connect 11, a second electrical connector 12 and, optionally, a third electrical connector 13. One or more of first through third electrical connectors 11-13 can be conductive pads CD, although it is especially preferred that all such connectors be electrical traces of a PCB or flex circuit. If third electrical connector 13 is present, it can help increase sensitivity of motion control switch 1, as both end sections 3 of spring 2 rest on an electrical connection in a rest mode, as is illustrated in FIG. 1.

Spring 2 is positioned relative to surface S by a barrier 20. Barrier 20 can be a battery block or switch block or pins or some other physical barrier or combination of such structures that maintains the position of spring 2 above first and second electrical connectors 11 and 12 so spring 2 does not need to be soldered to surface S. If a motion control switch in accordance with the present invention is integrated into a circuit board, assembly is greatly simplified because the spring need only be placed onto the circuit board and constrained by the barrier. Thus, for example, barrier 20 can be a battery block similar to that which is disclosed in U.S. Ser. No. 13/294,095, filed Nov. 10, 2011, the disclosure of which is specifically incorporated herein by reference in its entirety. After spring 2 is placed in position on top of a circuit board, it can be secured in place by the barrier as assembly is completed. Note that barrier 20 may have multiple components, such as an initial structure that assists in properly positioning spring on top of the circuit board, and then one or more additional components that complete the barrier, added once spring 2 has been positioned on the circuit board.

It is especially desirable that barrier 20 position spring 2 so that first electrical connector 11 is in constant, or near constant, electrical contact with outer section 2 positioned on it in the rest mode; however, it is desirable that there be some space or play between outer diameter 4 and barrier 20 so that barrier 20 does not compress outer diameter 4.

When motion control switch 1 is set in motion and it moves from a rest mode to a motion mode, the movement causes intermediate diameter 6 of spring 2 to make contact with second electrical connector 12 to complete an electrical circuit created when outer diameter 4 is in electrical contact with first electrical connector 11 and intermediate diameter 6 is in electrical contact with second electrical connector 12. The electrical circuit can be completed by use of any number of electronics and/or an integrated circuit and completion of the electrical circuit acts as a triggering or signal event when motion control switch 1 detects movement. Thus, for example, motion control switch 1 can send a signal to other electronics and/or an integrated circuit that movement has been detected, or such other electronics and/or integrated circuit can detect such movement as a result of the completed electrical circuit.

Figure 2:
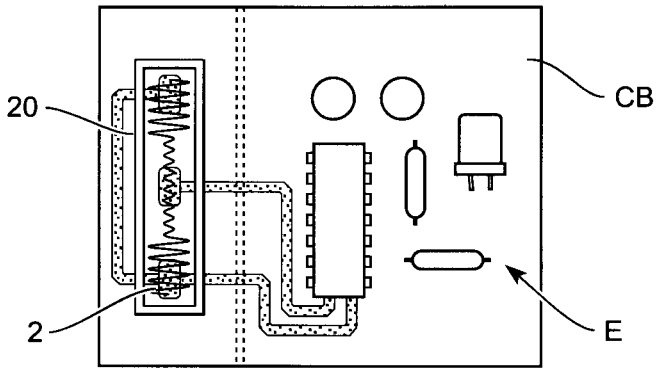
Figure 2A:
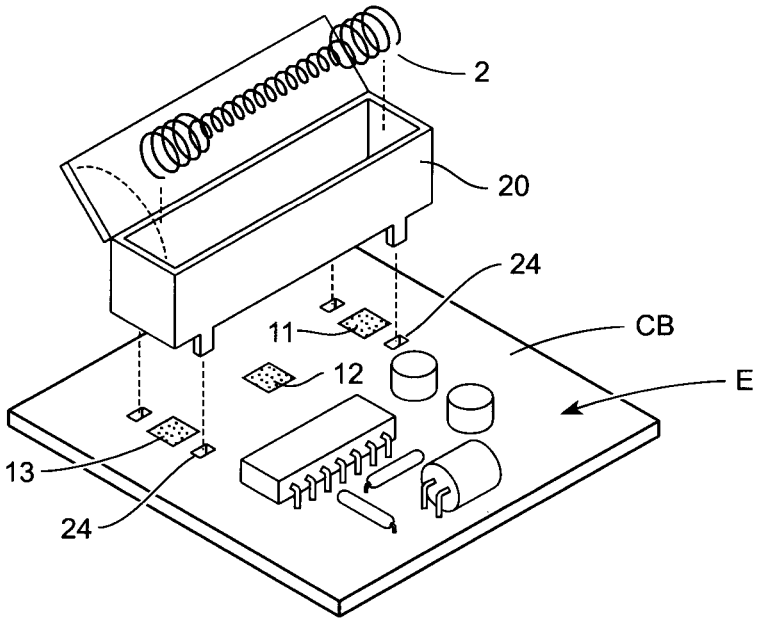
FIG. 2A is a partially exploded view of the same circuit board showing its parts during an assembly.

An example of one way in which a motion control switch according to the present invention can be assembled is illustrated in FIGS. 2 and 2A. FIG. 2 illustrates a top view of a circuit board to which the motion switch of FIG. 1 has been assembled by using a coffin box 21 with a hinged coffin box lid 22 as a barrier. In this illustrative embodiment coffin box 21 is secured to a circuit board CB (which is PCB 25) by pegs 23 on coffin box 21 which fit into holes 24, such as by interference fit or by going through PCB 25, once coffin box 21 is secured to PCB spring 2 is positioned within coffin box 21, and then hinged coffin box lid 22 is closed with a snap fit.

Figure 3:
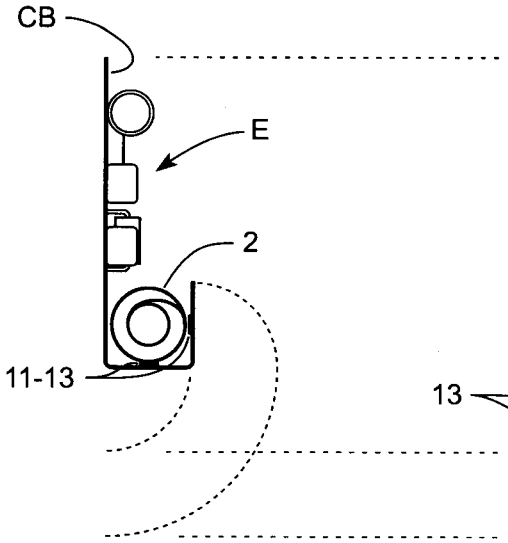
FIGS. 3 3A, and 3B illustrate a novel motion switch which uses a flex circuit in a non-linear configuration.
Figure 3B:
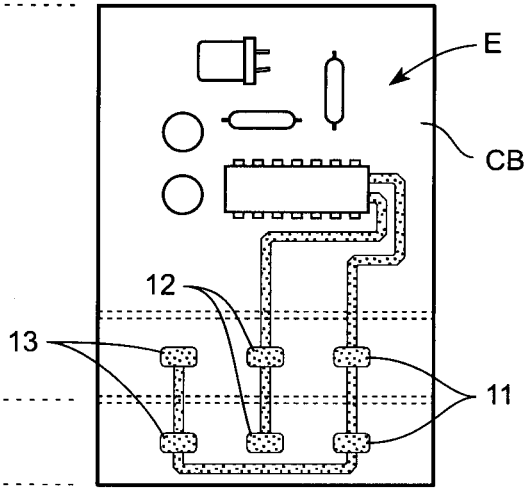
Figure 3A:
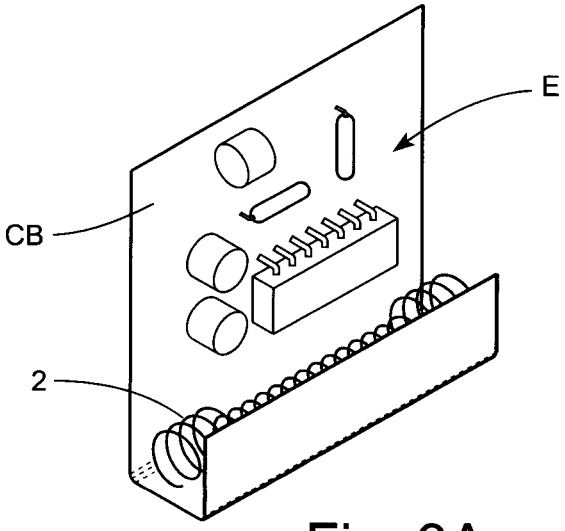

An alternative embodiment of a motion control switch according to the present invention, which might be particularly useful if it is desirable for most of the circuit board to lie in a vertical plane (e.g., for use in garments), takes advantage of a flex circuit 26 for the circuit board. In an example of such an embodiment depicted in FIGS. 3, 3A, and 3B, flex circuit 26 is bent at a ninety degree angle so the majority of flex circuit 26 is in a vertical orientation while a portion of the flex circuit 26 which contains electrical connectors is in a horizontal orientation. Note that FIG. 3A illustrates use of electrical connectors that are pads, although electrical traces can be used as well, in which case the electrical traces can be located to accommodate any desired size of the flex circuit, such as shown in FIG. 3A, or other configurations that allow spring 2 to contact such electrical traces in different planes or orientations, depending upon the orientation of motion control switch 1. Note also that while FIG. 3 only shows one pad on one vertical wall for ease of illustrations, both vertical walls of FIG. 3 can contain pads (or, as already noted, a continuous trace can be used).

While the invention has been described herein with reference to certain embodiments, those embodiments have been presented by way of example only, and not to limit the scope of the invention. Additional embodiments thereof will be obvious to those skilled in the art having the benefit of this detailed description.

Accordingly, it will be apparent to those skilled in the art that still further changes and modifications in the actual concepts described herein can readily be made without departing from the spirit and scope of the disclosed inventions as defined by the following claims.

What is claimed is:

1. An apparatus, comprising:

a spring that is electrically conductive having two outer sections with a maximum outer diameter greater than an intermediate diameter of an intermediate section of the spring located between the two outer sections;

a surface upon which the two outer sections rest in a rest mode;

a first electrical connector located under and in electrical contact with a first of the two outer sections in the rest mode;

a second electrical connector located under but not in electrical contact with the intermediate section in the rest mode, said second electrical connector being separated from the intermediate section by a non-conductive gap in the rest mode; and a barrier to movement of the spring in the rest mode and in a motion mode;

wherein the intermediate section, which is suspended between the two outer sections in the rest mode, moves between being separated from the second electrical connector by the non-conductive gap in a first rest mode to contacting the second electrical connector in the motion mode and then returns to being separated from the second electrical connector in a second rest mode;

wherein contact of the intermediate section with the second electrical connector in the motion mode completes an electrical circuit with contact of the first of the two outer sections with the first electrical connector to function as a motion switch; and wherein the surface is a circuit board.

2. The apparatus of claim 1, wherein the first of the two outer sections is not mounted to the surface and the apparatus is solder-free.

3. The apparatus of claim 1, wherein the two outer sections are located at two ends of the spring.

4. The apparatus of claim 3, wherein the intermediate section is located substantially in the middle of the spring.

5. The apparatus of claim 4, wherein the maximum outer diameter of the two outer sections is the same.

6. The apparatus of claim 1, wherein at least one of the first and the second electrical connectors is a conductive pad.

7. The apparatus of claim 1, wherein at least one of the first and the second electrical connectors is an electrical trace.

8. The apparatus of claim 1, wherein the first and the second electrical connectors are comprised of an electrical trace and the spring is comprised of a coiled spring.

9. The apparatus of claim 8, wherein the circuit board is a flex circuit, the first and the second electrical connectors are located about at least ninety degrees of an area of movement constraining the spring and contact of the intermediate section with the second electrical connector to complete the electrical circuit can be made along the area of movement.

10. The apparatus of claim 1, wherein the barrier restrains movement of the two outer sections in both the rest mode and the motion mode.

11. The apparatus of claim 1, wherein the first electrical connector remains in electrical contact with the first of the two outer sections in both the rest mode and the motion mode.

12. An apparatus, comprising:

a circuit board having a first and a second electrical contact;

a coiled spring that is electrically conductive having a greater outer diameter at two outer sections than an intermediate diameter at an intermediate section; and a barrier that positions the coiled spring relative to the first and the second electrical contact in a rest mode and in a motion mode such that an electrical circuit is completed in the motion mode by a first electrical connection between the first electrical contact with a first of two outer sections and a second electrical connection between the second electrical contact and the intermediate portion while the electrical circuit is broken in the rest mode;

wherein the intermediate section is suspended between the two outer sections in the rest mode and moves into contact with the second electrical connector in the motion mode.

13. The apparatus of claim 12, wherein the intermediate section is located substantially in the middle of the coiled spring, neither of the two outer sections are mounted to circuit board, and the first and the second electrical contact are comprised of a conductive trace formed in the circuit board.

14. The apparatus of claim 13, wherein the intermediate section has a greater mass density over a given length of the spring than two minimum portions of the spring, one of each of the two minimum portions of the spring being located betwen one of the two outer sections and the intermediate section.

15. The apparatus of claim 13, wherein the coiled spring is assembled into the apparatus by placing it within the barrier.

16. A method for manufacturing an electronic assembly containing a motion switch, comprising the steps of:

providing a circuit board having a first and a second electrical contact;

providing a barrier positioned relative to the first and the second electrical contacts;

placing a spring that is electrically conductive on the circuit board so that two outer sections of the spring having a greater outer diameter contact the circuit board and a first of the two outer sections contacts the first electrical contact while an intermediate portion of the spring located between the two outer sections which has a diameter less than the greater outer diameter is positioned above, but not in electrical contact with, the second electrical contact; and completing manufacture of the electronic assembly which constrains movement of the spring between a rest mode and a motion mode such that an electrical circuit is completed in the motion mode by a first electrical connection between the first electrical contact with the first of two outer sections and a second electrical connection between the second electrical contact and the intermediate portion while the electrical circuit is broken in the rest mode;

wherein the intermediate section is suspended between the two outer sections in the rest mode and moves into contact with the second electrical connector in the motion mode.

17. An apparatus, comprising:

a spring that is electrically conductive having two outer sections with a maximum outer diameter greater than an intermediate diameter of an intermediate section of the spring located between the two outer sections;

a surface upon which the two outer sections rest in a rest mode;

a first electrical connector located under and in electrical contact with a first of the two outer sections in the rest mode;

a second electrical connector located under but not in electrical contact with the intermediate section in the rest mode, said second electrical connector being separated from the intermediate section by a non-conductive gap in the rest mode; and a barrier to movement of the spring in the rest mode and in a motion mode;

wherein the intermediate section, which is suspended between the two outer sections in the rest mode, moves between being separated from the second electrical connector by the non-conductive gap in a first rest mode to contacting the second electrical connector in the motion mode and then returns to being separated from the second electrical connector in a second rest mode;

wherein contact of the intermediate section with the second electrical connector in the motion mode completes an electrical circuit with contact of the first of the two outer sections with the first electrical connector to function as a motion switch; and wherein the first of the two outer sections is not mounted to the surface and the apparatus is solder-free.

18. An apparatus, comprising:

a spring that is electrically conductive having two outer sections with a maximum outer diameter greater than an intermediate diameter of an intermediate section of the spring located between the two outer sections;

a surface upon which the two outer sections rest in a rest mode;

a first electrical connector located under and in electrical contact with a first of the two outer sections in the rest mode;

a second electrical connector located under but not in electrical contact with the intermediate section in the rest mode, said second electrical connector being separated from the intermediate section by a non-conductive gap in the rest mode; and a barrier to movement of the spring in the rest mode and in a motion mode;

wherein the intermediate section, which is suspended between the two outer sections in the rest mode, moves between being separated from the second electrical connector by the non-conductive gap in a first rest mode to contacting the second electrical connector in the motion mode and then returns to being separated from the second electrical connector in a second rest mode;

wherein contact of the intermediate section with the second electrical connector in the motion mode completes an electrical circuit with contact of the first of the two outer sections with the first electrical connector to function as a motion switch; and wherein the intermediate diameter is greater than a minimum diameter of two minimum sections of the spring, a first of the two minimum sections being located between the first of the two outer sections and the intermediate section, a second of the two minimum sections being located between a second of the two outer sections and the intermediate section.

19. The apparatus of claim 18, wherein each of the two outer sections have a substantially identical first length and each of the minimum sections have a substantially identical second length.

20. An apparatus, comprising:

a spring that is electrically conductive having two outer sections with a maximum outer diameter greater than an intermediate diameter of an intermediate section of the spring located between the two outer sections;

a surface upon which the two outer sections rest in a rest mode;

a first electrical connector located under and in electrical contact with a first of the two outer sections in the rest mode;

a second electrical connector located under but not in electrical contact with the intermediate section in the rest mode, said second electrical connector being separated from the intermediate section by a non-conductive gap in the rest mode;

a third electrical connector located under and in electrical contact with a second of the two outer sections in the rest mode; and a barrier to movement of the spring in the rest mode and in a motion mode;

wherein the intermediate section, which is suspended between the two outer sections in the rest mode, moves between being separated from the second electrical connector by the non-conductive gap in a first rest mode to contacting the second electrical connector in the motion mode and then returns to being separated from the second electrical connector in a second rest mode; and wherein contact of the intermediate section with the second electrical connector in the motion mode completes an electrical circuit with contact of the first of the two outer sections with the first electrical connector to function as a motion switch.

* * * * *